United States Patent [19]

Ellingson et al.

[11] Patent Number: 4,468,671

[45] Date of Patent: Aug. 28, 1984

[54] ANTENNA TOWER ASSEMBLY AND METHOD OF ATTACHING ANTENNAS

[75] Inventors: Gary L. Ellingson, Thief River Falls, Minn.; Wendell E. Miller, Warsaw, Ind.

[73] Assignee: Polar Research, Inc., Thief River Falls, Minn.

[21] Appl. No.: 272,313

[22] Filed: Jun. 10, 1981

[51] Int. Cl.[3] ..... H01Q 1/12; H01Q 3/04

[52] U.S. Cl. ..... 343/766; 343/890; 52/114

[58] Field of Search ..... 52/65, 110, 114, 148, 52/649, 653, 655; 343/757, 758, 763, 766, 879, 882, 890, 892; 248/218.4, 514

[56] References Cited

U.S. PATENT DOCUMENTS

| | | | |
|---|---|---|---|
| 2,290,692 | 7/1942 | Lindenblad | 343/879 |
| 2,623,999 | 12/1952 | Kulikowski | 343/758 |
| 2,642,754 | 6/1953 | Conti | 52/114 |
| 2,654,031 | 9/1953 | Mullins | 343/765 |
| 3,146,452 | 8/1964 | Rose | 343/758 |
| 3,246,431 | 4/1966 | Faerber | 52/65 |
| 3,541,570 | 11/1970 | Onnigian | 343/704 |
| 3,790,950 | 2/1974 | Smith et al. | 343/879 |
| 4,293,861 | 10/1981 | Winegard | 343/766 |

FOREIGN PATENT DOCUMENTS

| | | | |
|---|---|---|---|
| 1466609 | 2/1969 | Fed. Rep. of Germany | 343/763 |
| 808961 | 2/1959 | United Kingdom | 343/DIG 1 |

*Primary Examiner*—Eli Lieberman

*Attorney, Agent, or Firm*—Wendell E. Miller

[57] ABSTRACT

The present invention provides an apparatus and a method for mounting and both separate and selective rotational positioning of a plurality of separate antennas, or search devices, on a single tower. Three of the preferred embodiments for use in mounting and rotationally positioning antennas or search devices include an antenna-mounting ring, or search-device mounting ring (142, 292, or 406) that is attached to the tower (12) by a plurality of support rollers (160, 219, or 306). The support rollers are operatively attached to the tower or to the antenna-mounting ring and supportingly engage a circumferential groove (150, 298, or 430) which is located in either the antenna-mounting ring, or in a tower-attaching ring (402) that is interposed between the antenna-mounting ring and the tower. The preferred embodiment for use in mounting of antennas of the type that are rotationally positioned and then permanently left in that rotational position utilizes two vertically-spaced and arcuately-shaped mounting portions (42*a* and 42*b*).

30 Claims, 26 Drawing Figures

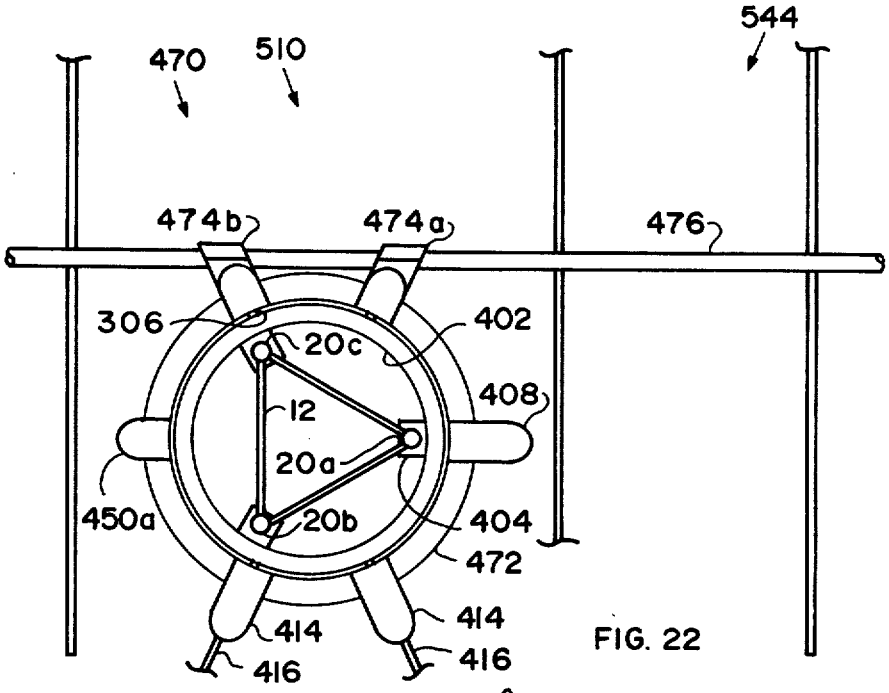
FIG. 22
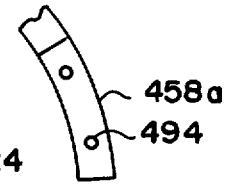
FIG. 24
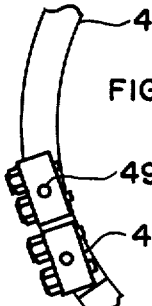
FIG. 26
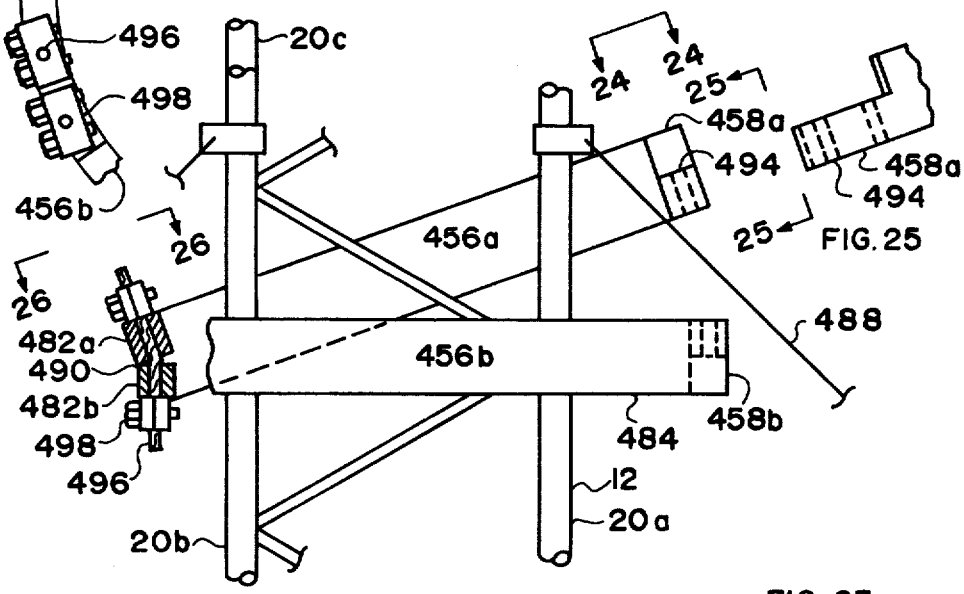
FIG. 25
FIG. 23

ANTENNA TOWER ASSEMBLY AND METHOD OF ATTACHING ANTENNAS

The present invention relates generally to antenna tower assemblies, and more particularly to apparatus and methods for mounting and rotating a plurality of vertically-spaced antennas on a single antenna tower.

BACKGROUND ART

It is common practice to mount a plurality of separate antennas, which may include both receiving and transmitting antennas, on a single antenna tower. Further, it is traditional practice to mount one of the antennas on the top of the antenna tower and to rotate the one antenna by means of an electric motor and gear reducer. The remainder of the antennas are then mounted to the face of the antenna tower at various heights thereto. Thus only one antenna, that is, the antenna which is mounted to the top of the tower, is rotatable, and the remainder of the antennas are fixedly secured to the antenna tower.

Alternately, several antennas are mounted to one antenna rotator on the top of the antenna tower. This method of mounting has the disadvantage that all antennas must be rotated together, thus greatly diminishing the usefulness of the various antennas. Also, this method of mounting is limited in the type and number of antennas that can be rotated because of structural limitations.

When it has been desirable, or necessary, to rotate one of the face-mounted antennas, it has been customary to attach this antenna to the antenna tower by means of an outrigger, or side arm, that extends longitudinally out from the antenna tower. When the antenna tower consists of three vertically-disposed tower legs and truss bracing, it has been customary to construct this side arm from a section of the tower material.

This face-mounted antenna is then mounted at the outer end of the side arm by means of a second electric motor and gear reducer. This type of mounting for a rotatable antenna is highly unsatisfactory because of the effect of the metal in the antenna tower. That is, when this face-mounted and rotatable antenna is directed so that the antenna tower is directly behind the antenna, the antenna may be tuned for high performance. However, as the antenna is rotated to an angle where the antenna tower is to one side or the other of the antenna, the tuning of the antenna will be adversely affected. Further, as the antenna is rotated farther, not only will the tuning of the antenna further deteriorate, but also, the direction-sensing ability of the antenna will be adversely affected. That is, if this rotatable antenna is used as a search antenna, false directional readings will be indicated. Then, as the antenna is rotated to face the antenna tower, its tuning will be degraded even more, making the antenna highly ineffective either for transmission or receiving of radio frequencies.

Alternately, face-mounted antennas have been rotated by rotating the entire antenna tower. Of course, this requires an extremely large, heavy, and costly mechanism, is practical only for relatively short antenna towers of the non-guy-wired type, and has the additional disadvantage that all antennas are rotated simultaneously.

Kulikowski, in U.S. Pat. No. 2,623,999, shows an antenna that is mounted to a sleeve which is disposed coaxially around an antenna tower of the tubular mast type, and that is rotated by an electric drive motor.

Kulikowski teaches a method of conductance coupling of the antenna to the lead-in conductors; but he does not address the technical problems of providing a workable rotating mount for face-mounting antennas to an antenna tower.

In particular, Kulikowski does not show, disclose, claim, or even intimate the need for, nor solutions for: vertically supporting the antenna, radially guiding the antenna, guiding against sideward tipping of the antenna-mounting ring, counterbalancing of torsional wind loads, use with towers of the trussed tower-leg type rather than the tubular mast type, electrical heating to overcome icing problems, or means for partially assembling the rotating device at ground level and then moving up past guy wires, all of which are advancements of the present invention.

DISCLOSURE OF INVENTION

In accordance with the broader aspects of this invention, there is provided an antenna tower assembly for the mounting and separately rotating of a plurality of vertically-disposed antennas on a single antenna tower.

In a preferred configuration, a single, two-piece antenna-mounting ring is mounted coaxially around an antenna tower of the type having three vertically-disposed tower legs. This antenna-mounting ring includes a V-shaped groove that is circumferentially disposed in an inner circumferential surface of the antenna-mounting ring.

Three support rollers, having vertically-disposed roller shafts, cooperate with upper and lower surfaces of the V-shaped groove in the antenna-mounting ring to rotatably support the antenna-mounting ring. Two of these support rollers are mounted to respective ones of two of the vertically-disposed tower legs by means of a support-roller assembly. A third one of the support rollers is mounted to the third of the tower legs by means of a support and drive assembly that includes an electric motor and gear reduction unit.

Preferably, the antenna-mounting ring includes a plurality of circumferentially-spaced gear teeth; and the roller shaft of the third support roller includes a drive pinion which meshes with the circumferentially-spaced teeth in the antenna-mounting ring and which is driven by the gear reduction unit.

In a second preferred embodiment, the roller shafts of the three support rollers are horizontally disposed; and the support rollers are frustoconical in shape. In this embodiment, the frustoconical support rollers engage a groove that is circumferentially disposed in the inner surface of the antenna-mounting ring. The antenna-mounting ring is rotated by a drive pinion whose shaft is horizontally disposed below one of the roller shafts and which engages circumferentially-spaced gear teeth on the antenna-mounting ring. These circumferentially-spaced gear teeth are disposed separate from and below the circumferential groove in the antenna-mounting ring.

In a third preferred embodiment, a tower-attaching ring circumscribes the three tower legs and is securely attached thereto. An antenna-mounting ring is coaxial to and circumscribes the tower-attaching ring. The antenna-mounting ring is rotatably mounted to, and supported by, the tower-attaching ring by means of a plurality of support rollers which are rotatably mounted to the antenna-mounting ring and which engage a groove that is circumferentially disposed in the outer surface of the tower-attaching ring. The support rollers are mounted for rotation about horizontal axes that are radially disposed with respect to a vertical axis of the antenna tower.

An electric drive motor and gear reduction unit are mounted to, and rotate with, the antenna-mounting ring. This electric drive motor and gear reduction unit rotate a drive pinion which is mounted for rotation about an axis that is both horizontal and radially disposed with respect to a vertical tower axis. The tower-attaching ring includes a plurality of circumferentially-spaced teeth which mesh with the teeth of the drive pinion.

In a fourth preferred embodiment, a first arcuately-shaped mounting portion is secured to the three tower legs, a second arcuately-shaped mounting portion is secured to the three tower legs at a vertically-spaced distance from the first arcuately-shaped mounting portion, and the mounting bracket for the antenna attaches to and slides circumferentially around the two arcuately-shaped mounting portions. Rotational positioning of the antenna of this fourth embodiment is by means of manually-turned screws.

BRIEF DESCRIPTION OF THE DRAWINGS

FIG. 22 is a partial top view of an antenna tower assembly similar to that of FIG. 19, but illustrating a modification thereof for use with large Yagi antennas;

FIG. 23 is a partial side elevation showing the method of moving tower-attaching rings and antenna-mounting rings above guy wires;

FIG. 24 is a partial top view, taken substantially as shown by view line 24—24 of FIG. 23;

FIG. 25 is a partial side view, taken substantially as shown by view line 25—25 of FIG. 23; and FIG. 26 is a partial top view, taken substantially as shown by view line 26—26 of FIG. 23.

BEST MODE FOR CARRYING OUT THE INVENTION

Figures 1, 2, 3, 4:
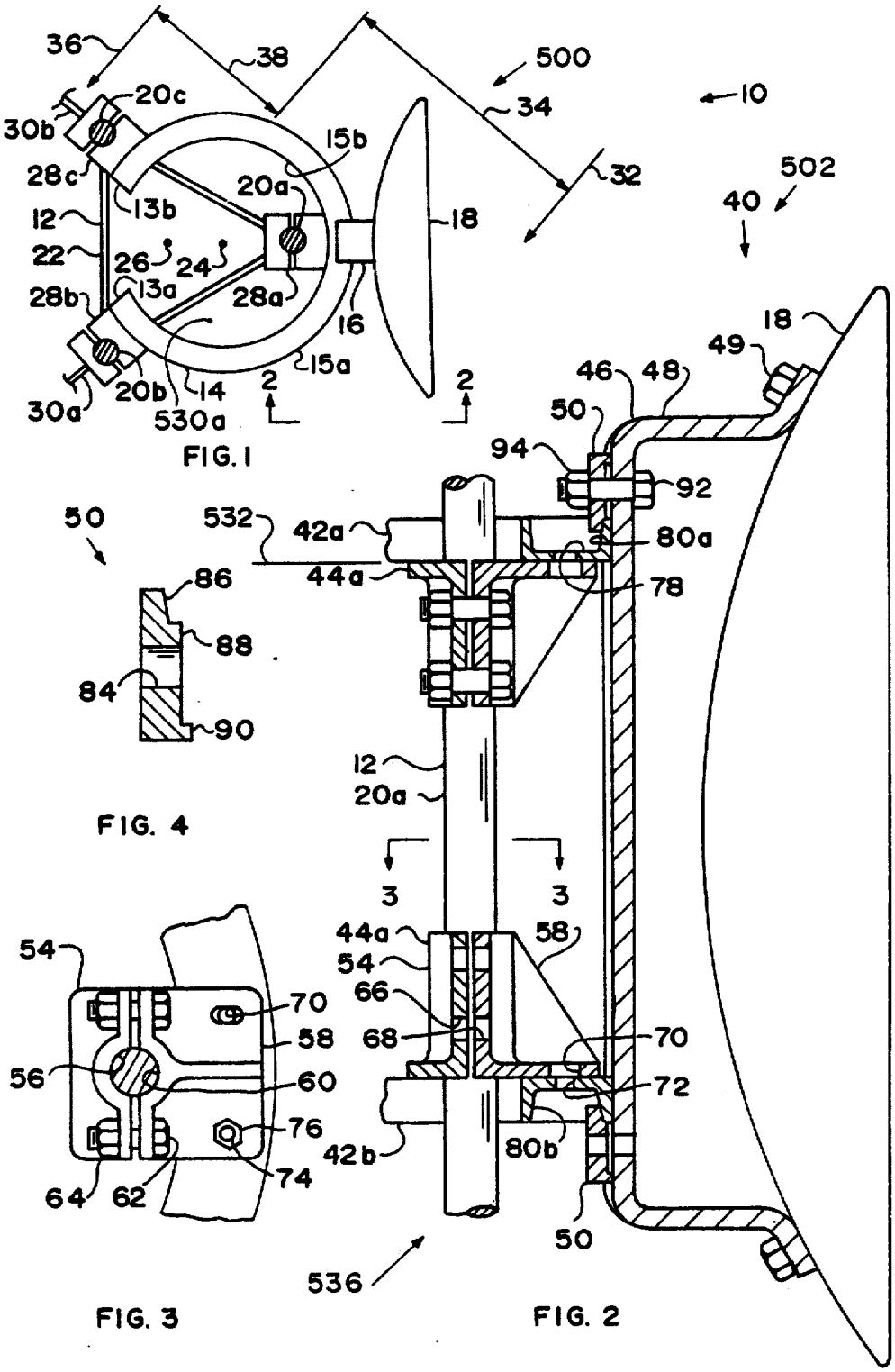
FIG. 1 is a schematic top view of a variation of the preferred embodiment of FIGS. 2–6.
FIG. 2 is a side elevation, taken substantially as shown by view line 2—2 of FIG. 1, showing the construction of the preferred embodiment wherein the antenna is manually rotated and then locked at a desired rotational position.
FIG. 3 is a cross-sectional view, taken substantially as shown by section line 3—3 of FIG. 2, showing construction of the attaching bracket.
FIG. 4 is an enlarged detail drawing of the guide plate of FIGS. 2 and 5, taken as shown in FIG. 2.

Referring now to the drawings, and more particularly to FIG. 1, an antenna tower assembly 10 includes an antenna tower 12, an arcuately-shaped first mounting portion or arcuate segment 14 having ends 13*a* and 13*b* and having arcuate surfaces 15*a* and 15*b* that are intermediate of the ends 13*a* and 13*b*, a second mounting portion 16, and an antenna 18.

The antenna tower 12 includes vertically-disposed tower legs, 20*a*, 20*b*, and 20*c*, which are interconnected by truss bracing 22. The arcuately-shaped first mounting portion 14 is disposed radially outside the tower leg 20*a* and is disposed radially inside the tower legs 20*b* and 20*c*; so that a vertical axis 24 of the mounting portion 14 is disposed radially inside the antenna tower 12 but is disposed horizontally from a neutral axis 26 of the antenna tower 12.

The arcuately-shaped first mounting portion 14 is attached to the tower legs 20*a*, 20*b*, and 20*c* by respective ones of mounting brackets 28*a*–28 *c*.

The antenna tower assembly 10 further includes wind-resisting members or wind vanes 30*a* and 30*b* which function to provide torsional wind-balance means. When wind impinges against the antenna 18 from any angle, a force is produced. This force is indicated by a force vector 32. In the FIG. 1 illustration, the force vector 32 causes a clockwise torque to be applied to the tower 12 that is the product of the force vector 32 and a moment arm 34 which is the orthogonal distance from the force vector 32 to the neutral axis 26 of the tower 12.

Wind impinging upon the wind-resisting member 30*b* produces a force as indicated by a force vector 36, producing a counterclockwise torque that is the product of the force vector 36 and a moment arm 38 which is the orthogonal distance from the force vector 36 to the neutral axis 26 of the tower 12. Thus the size of the wind-resisting member 30*b* can be selected, and/or the moment arm 38 can be changed, to provide effective torque balance for any size or type of antenna.

In like manner, with wind impinging upon the antenna 18 at various other angles, both of the wind-resisting members, 30*a* and 30*b*, provide torque-balancing forces.

Referring now to FIGS. 2–6, an antenna tower assembly 40 includes an antenna tower 12 having vertically-disposed tower legs 20*a*–20*c* and truss bracing 22, an arcuately-shaped first mounting portion or arcuate segment 42*a* that is disposed radially outside the tower legs 20*a*–20*c* and that is attached to the tower legs 20*a*–20*c* by respective ones of attaching brackets 44*a*–44*c*, an arcuately-shaped second mounting portion 42*b* that is similarly disposed with respect to the tower legs 20*a*–20*c* and that is similarly attached thereto, a third mounting portion 46 which includes an antenna mounting bracket 48 and guide or clamp plates 50, and an antenna 18 that is operatively secured to the mounting bracket 48 by bolts 49, and adjusting bracket assemblies 52*a* and 52*b*.

Each of the attaching brackets, such as the attaching bracket 44*a* of FIGS. 2 and 3, includes an inner portion 54 having a cylindrical surface 56 and an outer portion 58 having a cylindrical surface 60. The cylindrical surfaces 56 and 60 are sized to fit the tower leg 20*a*; and the portions 54 and 58 are secured to the tower leg 20*a* by bolts 62 and nuts 64 which are disposed in holes 66 and 68.

The outer portion 56 of the attaching bracket 44*a* includes elongated holes 70 which are positioned to cooperate with holes 72 in the mounting portions, 42*a* and 42*b*, and bolts 74 and nuts 76 are used to secure the mounting portions 42*a* and 42*b* to respective ones of the attaching brackets, 44*a*–44*c*.

The first and second mounting portions, 42*a* and 42*b*, are rolled from channel iron; and so the first and second mounting portions, 42*a* and 42*b*, each include a web 78 and arcuately-shaped flanges 80*a* and 80*b*. The arcuately-shaped flange 80*a* includes an arcuately-shaped outer surface 82*a* and an arcuately-shaped inner surface 82*b*.

Referring now to FIG. 4, the guide or clamp plates 50 each include a hole 84, a beveled surface 86 that conforms to the arcuately-shaped inner surfaces 82*b* of the mounting portions 42*a* and 42*b*, a relieved surface 88, and a pivot lug 90. Bolts 92 and nuts 94 are used to secure the guide or clamp plates 50 to the antenna mounting bracket 48.

To allow the antenna 18 to be rotationally positioned, the nuts 94 are loosened, allowing the bracket 48 and the guide or clamp plates 50 to slide with respect to the arcuately-shaped first and second mounting portions, 42*a* and 42*b*. The nuts 94 are tightened after radially positioning the antenna 18, thereby locking the antenna 18 in a selected rotational position by forcing the beveled surface 86 of the guide or clamp plate 50 into contact with the arcuately-shaped inner surface 82*b*.

Figure 5:
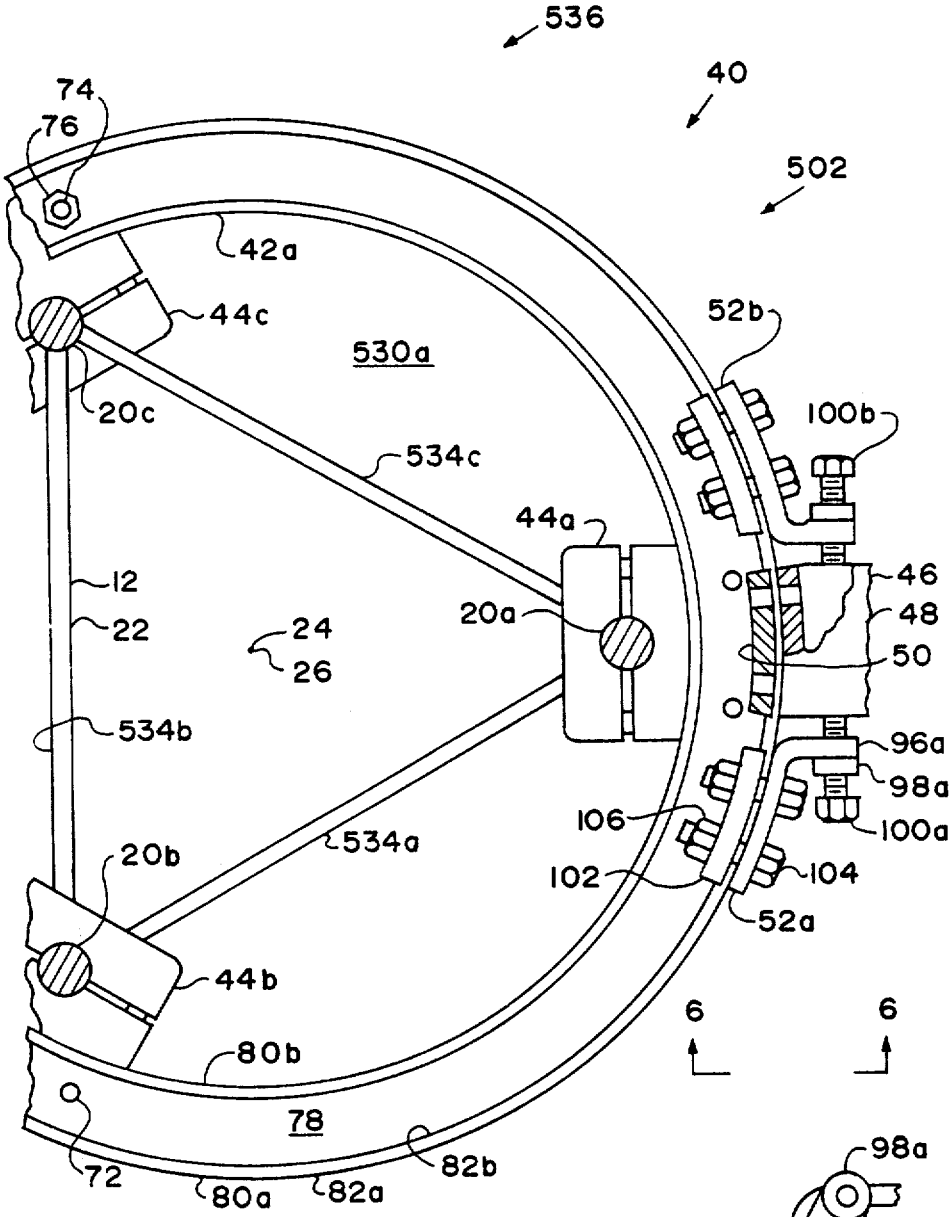
FIG. 5 is a top plan view of the preferred embodiment of FIG. 2.
Figure 6:
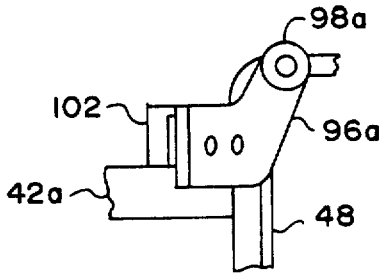
FIG. 6 is a partial side view, taken substantially as shown by view line 6—6 of FIG. 5.

Referring now to FIGS. 5 and 6, the adjusting bracket assemblies 52*a* and 52*b* are identical except for being mirror images of each other; so a description of one will suffice for both. The adjusting bracket assembly 52*a* includes an adjusting bracket 96*a* having a threaded boss 98*a*, an adjusting screw 100*a* that is threaded through the boss 98*a*, a clamp plate 102 that is similar to the clamp plate 50, and bolts 104 and nuts 106.

Referring now to FIGS. 2 and 5, the method of rotationally positioning the antenna 18 includes loosening the nuts 94, tightening the nuts 106, manually turning an adjusting screw, 100*a* or 100*b*, and tightening the nuts 94. Optionally, or alternately, the antenna 18 may be securely locked in a desired rotational position by forcing both the adjusting screws 100*a* and 100*b* against the antenna-mounting bracket 48.

Figures 7, 8:
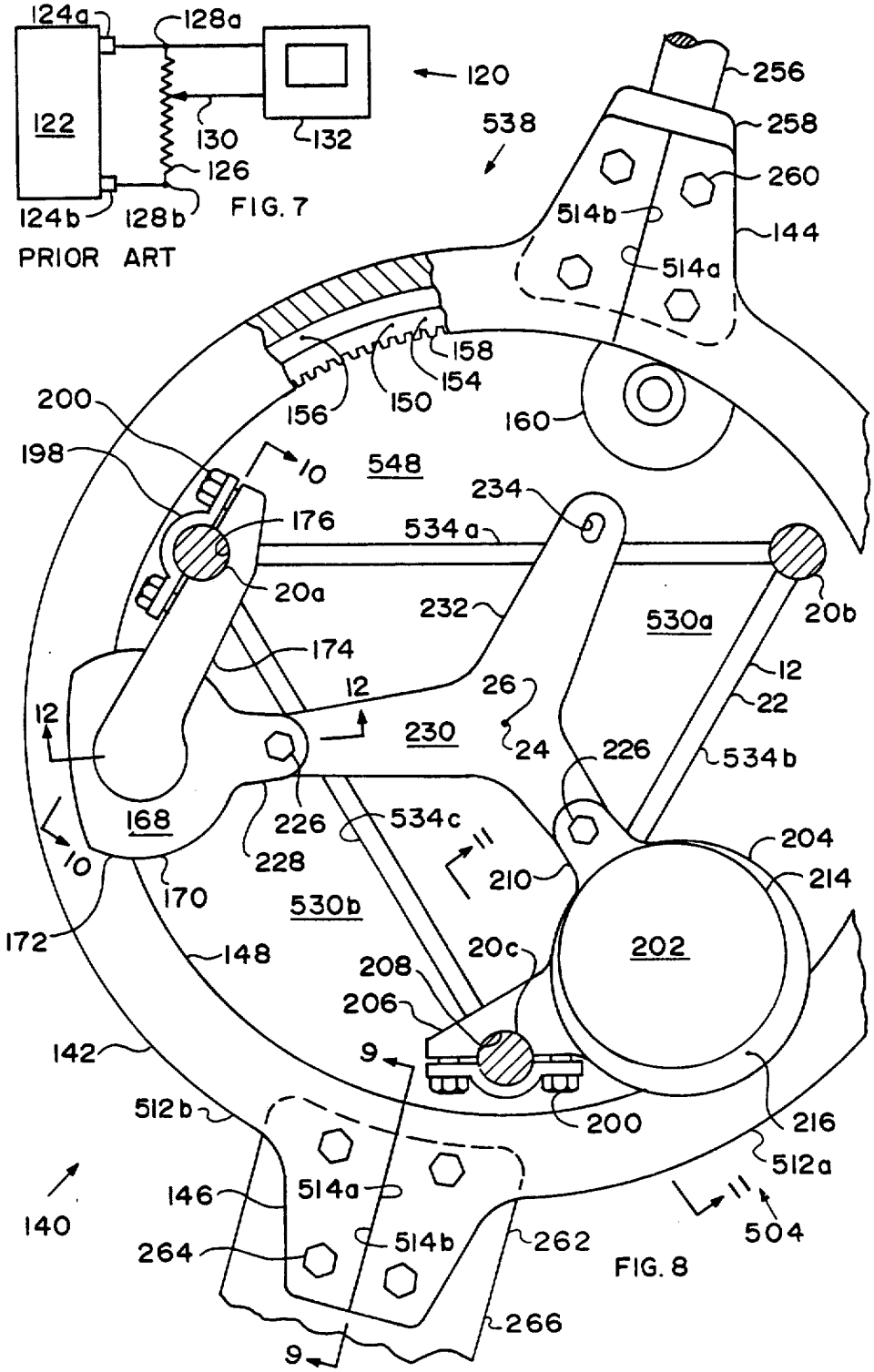
FIG. 7 PRIOR ART
FIG. 7 is a schematic drawing of a direction-indicating device for the embodiments of the succeeding figures.
FIG. 8 is a top plan view of a preferred embodiment in which the roller shafts for the support rollers are vertically disposed.

Referring now to FIG. 7, each of the antenna tower assemblies that will be subsequently described includes a position indicator 120. The position indicator 120 includes a regulated power supply 122 having output terminals 124*a* and 124*b*, a potentiometer 126 having legs 128*a* and 128*b* that are connected respectively to the output terminals 124*a* and 124*b* and having an arm 130, and an electrical meter 132 that is connected to the leg 128*a* and to the arm 130 of the potentiometer 126. The potentiometer 126 schematically represents a ten-turn potentiometer, such as is common in the electronics industry.

The use of a ten-turn potentiometer, and an electrical circuit, such as is shown in FIG. 7, to indicate the rotational position of an antenna, is common to the art.

Figure 12:
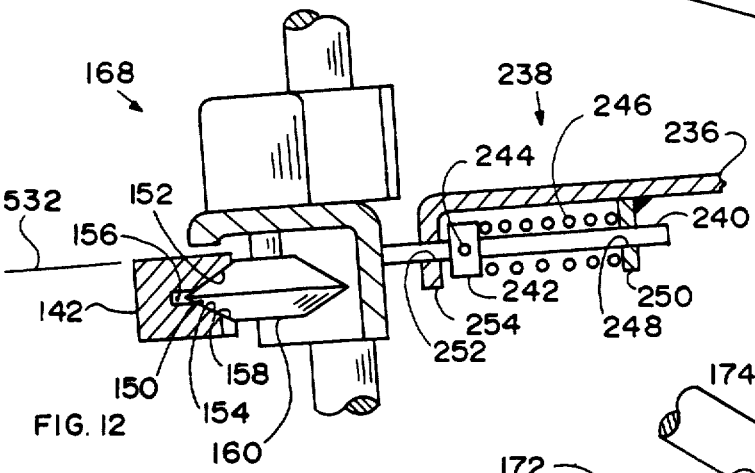
FIG. 12 is a cross-sectional view, taken substantially as shown by section line 12—12 of FIG. 8, showing a modification of the support roller assembly wherein the support roller is resiliently urged into contact with the antenna-mounting ring by a spring.

Referring now to FIGS. 8 and 12, an antenna tower assembly 140 comprises an antenna tower 12 having vertically-disposed tower legs, 20*a*–20*c*, and truss bracing 22. The antenna tower assembly 140 further comprises an antenna-mounting ring 142 having an antenna-attaching lug 144, a counterbalance and wind vane attaching lug 146, a circumferential inner surface or circumferential ring surface 148, a V-shaped circumferential groove 150 that includes an upper groove surface or upper circumferential surface 152, and a lower groove surface or lower circumferential surface 154, a relief groove 156, and a plurality of circumferentially-spaced gear teeth 158.

Figure 10:
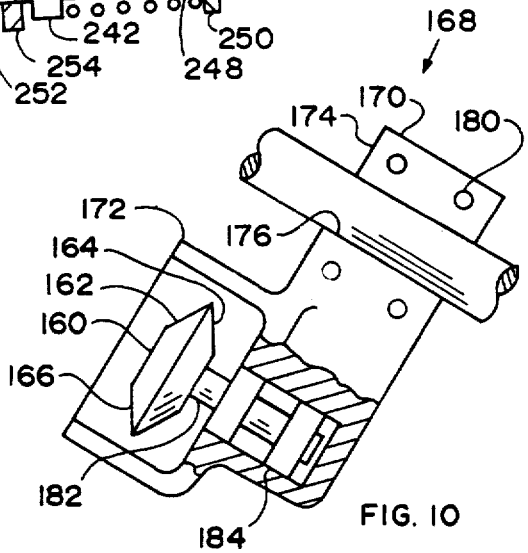
FIG. 10 is a partial side elevation, taken substantially as shown by view line 10—10 of FIG. 8, showing a support roller assembly.

The antenna-mounting ring 142 is supportingly, guidingly, and rotatably attached to the antenna tower 12 by three support rollers such as a support roller 160 of FIGS. 8, 10, and 12.

Referring now to FIG. 10, the support roller 160 includes a wedge-shaped circumferential surface 162 having an upper circumferential support surface 164 that supportingly engages the upper groove surface 152, and having a lower circumferential guide surface 166 that cooperates with the lower groove surface 154 to prevent tilting of the antenna-mounting ring 142.

Referring now to FIGS. 8 and 10, a support roller assembly 168 includes a support housing 170 having a bell-shaped shield 172, a mounting arm 174 having a cylindrical recess 176 therein, and threaded holes 180. The support roller 160 includes a roller shaft 182 which is secured in the housing 170 by longitudinally-spaced ball bearings 184.

Figure 13:
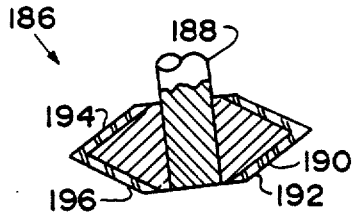
FIG. 13 is an enlarged and partial view of a support roller, taken substantially as shown in FIG. 12, showing a resilient drive surface which may be used in place of the drive pinion of FIG. 11.

Referring now to FIG. 13, in an optical configuration, a support roller 186 includes roller shaft 188. The support roller 186 also includes a roller body 190 which is preferably fabricated from steel, and a resilient cover 192 of molded rubber. Thus, the support roller 186 includes a resilient upper or support surface 194 and a resilient lower or guide surface 196.

Referring again to FIGS. 8 and 10, one of the support roller assemblies 168 is attached to the tower leg 20a by a bracket 198 and by bolts 200 that threadably engage the threaded holes 180. A support roller assembly, not shown, which is identical to the support roller assembly 168, is attached to the tower leg 20b, the support roller 160 thereof being illustrated.

Figure 11:
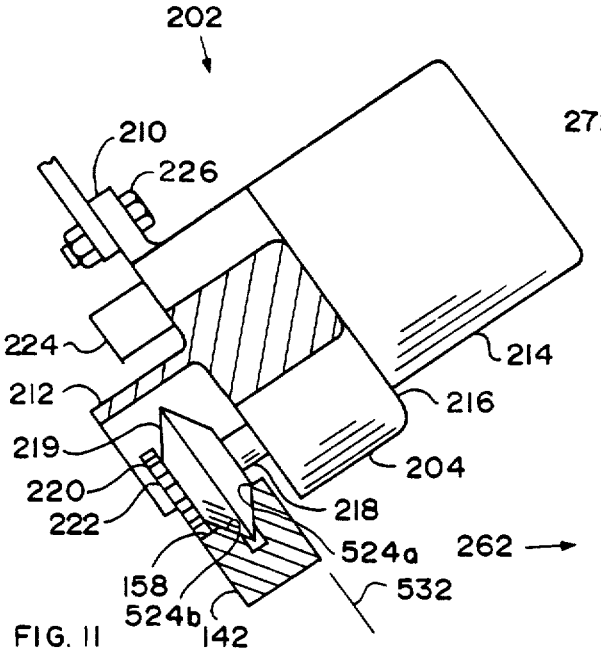
FIG. 11 is a cross-sectional view, taken substantially as shown by section line 11—11 of FIG. 8, showing the support and drive assembly.

Referring now to FIGS. 8 and 11, a support and drive assembly 202 includes a support housing 204 having a mounting arm 206 with a cylindrical recess 208 therein, having an adjusting lug 210, and having a shield portion 212.

The support and drive assembly 202 includes an electric drive motor and gear reducer unit 214 that is attached to a surface 216 of the housing 204 and that is attached to a roller shaft 218. The roller shaft 218 projects through the housing 204.

The support and drive assembly 202 also includes a support roller 219 which is identical to the support roller 160 of FIG. 12 except that the support roller 219 includes the roller shaft 218; and so the support roller 219 includes all of the surfaces as previously described for the support roller 160.

The support and drive assembly 202 also includes a toothed drive pinion 220 that is coaxially attached to the roller shaft 218 and that includes gear teeth 222 which progressively mesh with the gear teeth 158 of the antenna-mounting ring 142.

Finally, the support and drive assembly includes a ten-turn potentiometer 224 that is driven by the electric motor and gear reducer unit 214. The potentiometer 224 and the connection thereof to the electric drive motor and gear reducer unit 214 are conventional and do not comprise an inventive part of the present invention.

Referring now to FIG. 8, the support roller assembly 168 may be rotationally positioned about the tower leg 20a by loosening the bolts 200 and a bolt 226 that attaches an adjusting lug 228 of the housing 170 to a spider plate 230. The spider plate 230 includes three legs 232, each of which includes an elongated adjusting hole 234. In like manner, the support and drive assembly 202 may be rotationally positioned about the tower leg 20c by loosening the bolts 200 and the bolt 226.

Referring again to FIGS. 8 and 10–12, when any one of the support rollers 160 or 219 is rotationally positioned about the respective one of the tower legs, 20a–20c, providing close proximity between all the guide surfaces 166 of the support rollers 160 or 219 and the lower groove surface 154 of the antenna-mounting ring 142, the gear teeth 222 of the drive pinion 220 engage the gear teeth 158 of the antenna-mounting ring 142 with proper backlash.

Referring now to FIGS. 8, 12, and 13, alternately, the spider plate 230 may be modified to provide one leg 236 that includes a spring tension device 238. The spring tension device 238 includes a cylindrical rod 240, a collar 242 which is attached to the rod 240 by a transverse pin 244, and a spring 246. The rod 240 is inserted through a hole 248 in a lug 250 and through a hole 252 in a lug 254, the lug 250 being welded to the leg 236 as shown and the lug 254 being integral with the leg 236. In this modification, the bolts 200 are left slightly loose or shims, not shown, are placed between the bracket 198 and the arm 174 so that the bolts 200 can be tightened without the cylindrical recess 176 being tightened against the tower leg 20a. Therefore, rather than the spider plate 230 being attached to the housing 170 by the lug 228, the rod 240 presses against the housing 170 and resiliently urges the housing 170 to rotate outwardly about the antenna tower leg 20a, thereby resiliently urging the support roller 160 thereof into resilient engagement with both the upper groove surface 152 and the lower groove surface 154 of the V-shaped groove 150. In this adaptation, preferably, the toothed drive pinion 220 and the circumferentially-spaced gear teeth 158 are deleted and the support roller 186, with the resilient surfaces 194 and 196, is used to drive the antenna-mounting ring 142 by friction engagement of the resilient surfaces 194 and 196 with respective ones of the groove surfaces 152 and 154.

Figure 9:
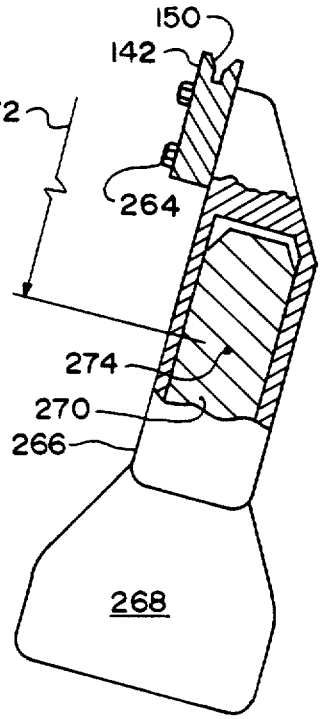
FIG. 9 is a cross-sectional view, taken substantially as shown by section line 9—9 of FIG. 8, showing in reduced scale, the counterweight and wind-vane assembly.

Referring now to FIGS. 8 and 9, an antenna 256 that includes an attaching lug 258 is attached to the lug 144 of the antenna-mounting ring 142 by bolts 260. In like manner, a counterbalance and wind vane assembly 262 is attached to the lug 146 by bolts 264. The counterbalance and wind vane assembly 262 includes a housing 266, a wind vane or wind-resisting member 268, and a counterbalance weight 270 that is retainably inserted into the housing 266. The wind-resisting member 268 is sized and proportioned to provide a wind-resisting force and torque balance to match and counteract the wind-resisting force and torque applied to the antenna tower 12 by the antenna 256 in the same manner as described in conjunction with FIG. 1; and the counterbalance weight 270 is sized to effectively counterbalance torque that is applied to the antenna-mounting ring 142 by the antenna 256. That is, the product of the weight of the counterbalance weight 270 times a distance 272 from a neutral axis 26 of antenna tower 12 to a centroid 274 of the weight 270 is adjusted to substantially equal the weight of the antenna 256 times the distance (not shown) from the neutral axis 26 of the antenna tower 12 to the centroid (not shown) of the weight of the antenna 256.

Figure 14:
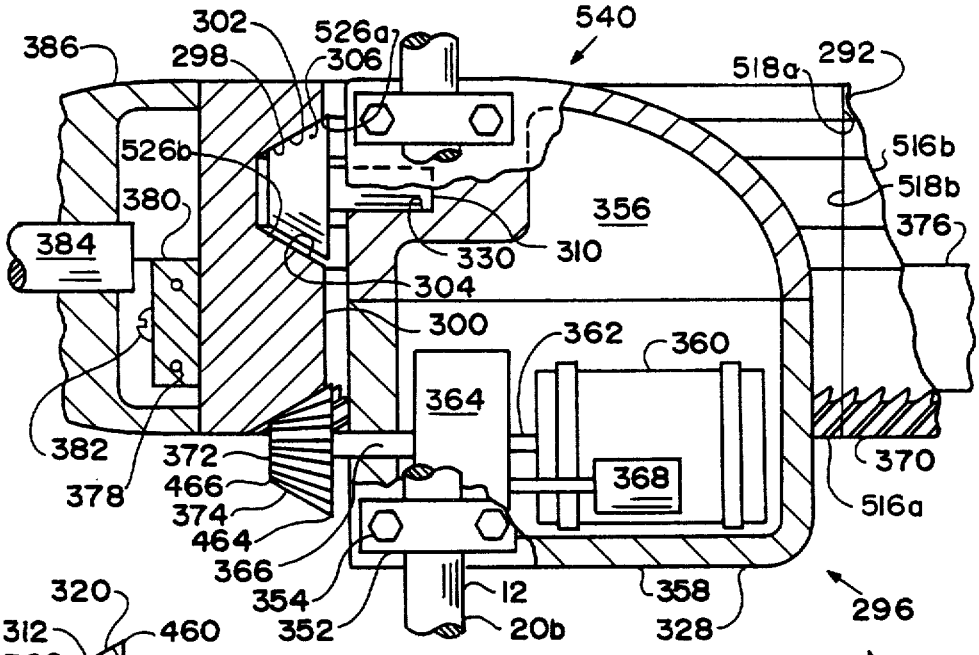
FIG. 14 is a cross-sectional view of an embodiment in which a support and drive assembly is secured to one of the tower legs, the support roller thereof rotates about a horizontally and radially-disposed axis, and the electric drive motor is fixedly secured with respect to the antenna tower.
Figure 15:
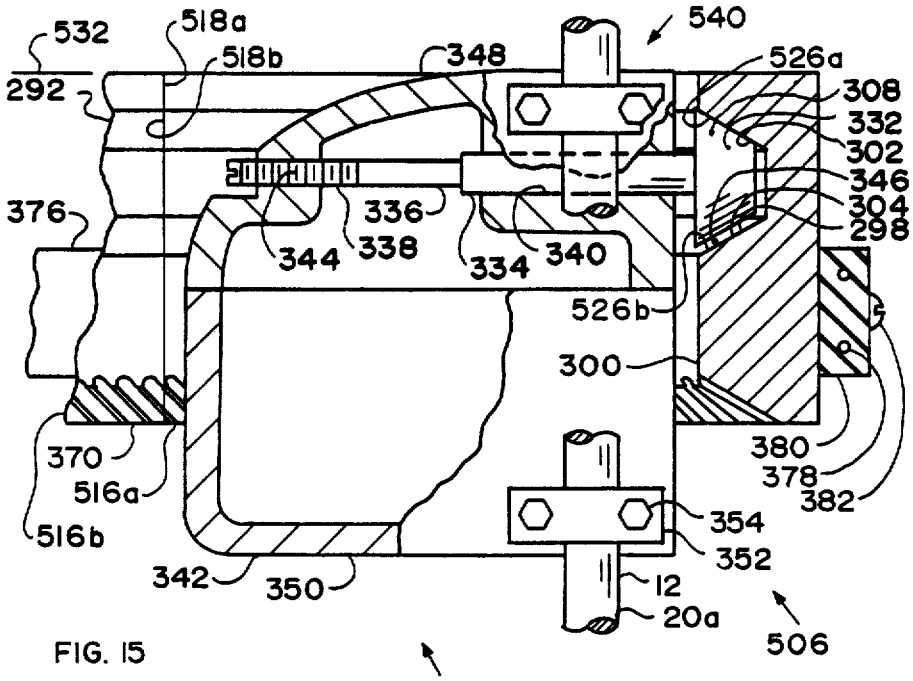
FIG. 15 is a cross-sectional view of a support roller assembly for the embodiment of FIG. 14.

Referring now to FIGS. 14 and 15, an antenna tower assembly 290 includes an antenna tower 12 having vertically-disposed tower legs 20a and 20b and a third vertically-disposed tower leg (not shown), an antenna-mounting ring 292 that is circumferentially disposed around the antenna tower 12, a support roller assembly 294 that is attached to the tower leg 20a, a support and drive assembly 296 that is attached to the tower leg 20b, and a second support roller assembly (not shown) that is identical to the support roller assembly 294 and that is attached to a third tower leg (not shown).

The antenna-mounting ring 292 includes a V-shaped groove 298 that is circumferentially disposed in a circumferential inner surface or circumferential ring surface 300 of the antenna-mounting ring 292. The groove 298 includes an upper groove surface or upper circumferential surface 302, and a lower groove surface or lower circumferential surface 304.

Figure 16:
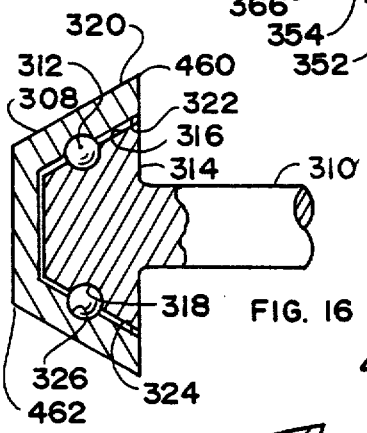
FIG. 16 is an enlarged and cross-sectional view of the support roller and bearing assembly for the embodiment of FIGS. 14 and 15 and for the embodiment of FIGS. 17–20.

Referring now to FIGS. 14 and 16, and more particularly to FIG. 16, a roller and bearing assembly 306 includes a support roller 308, a roller shaft 310, and a plurality of circumferentially-disposed steel balls 312. The roller shaft 310 includes an enlarged portion 314 having a frustoconical surface 316 and a circumferential ball groove 318 that is disposed in the surface 316. The support roller 308 includes a frustoconical outer surface 320, a bore 322 having a frustoconical inner surface 324, and a circumferentially-disposed ball groove 326 in the inner surface 324. The balls 312 are circumferentially disposed in the grooves 318 and 326, thereby providing an integral ball bearing beteen the support roller 308 and the roller shaft 310.

The roller shaft 310 is attached to a support housing 328 of the support and drive assembly 296 by inserting the roller shaft 310 into a bore 330 of the housing 328.

Referring now to FIG. 15, the support roller assembly 294 includes a roller and bearing assembly 332 that is identical with the roller and bearing assembly 306 except that the roller and bearing assembly 332 includes a longer roller shaft 334 and an integral adjusting screw 336 with a threaded portion 338.

The roller shaft 334 is slidably and rotatably received into a bore 340 of a support housing 342 of the support roller assembly 294; and the threaded portion 338 is threadingly received into a threaded bore 344 of the housing 342. Thus rotation of the adjusting screw 336 is effective to radially adjust the support roller 308; and radial adjustment of the support roller 308 is effective to control a clearance 346 between the support roller 308 and the lower or guide surface 304 of the antenna-mounting ring 292.

The housing 342 of the support roller assembly 294 includes an upper housing portion 348 and a lower housing portion 350 which are interconnected by any suitable means.

The support roller assembly 294 is attached to the tower leg **20*a* of the antenna tower 12 by brackets 352 and bolts 354**.

The housing 328 of the support and drive assembly 296 includes an upper housing portion 356 and a lower housing portion 358 that are interconnected by any suitable means. An electric drive motor 360 having an output shaft 362 is mounted in the lower housing portion 358. A gear reducer unit 364 is mounted in the lower housing portion 358, is attached to the output shaft 362 of the electric drive motor 360 and includes an output shaft 366. Also a ten-turn potentiometer 368 is mounted in the lower housing portion 358 and is connected to and driven by the gear reducer unit 364.

The antenna-mounting ring 292 includes a plurality of circumferentially-spaced gear teeth 370; and the support and drive assembly 296 includes a bevel gear or toothed drive pinion 372 being coaxially mounted onto the output shaft 366 and having gear teeth 374 that progressively mesh with the gear teeth 370 as the drive pinion 372 is rotated by the electric drive motor 360 and rotates the antenna-mounting ring 292.

The support and drive assembly 296 is attached to the tower leg **20*b* by brackets 352 and bolts 354**.

Referring again to FIGS. 14 and 15, an electrical resistance heating unit 376 which includes an electrical resistance unit 378 and a molded body 380 of dielectric material is circumferentially disposed around the antenna-mounting ring 292 and is attached thereto by screws 382. The antenna tower assembly 290 further includes an antenna 384 that is attached to the antenna-mounting ring 292 by a housing 386.

Referring now to FIGS. 8, 9, 14, and 15, preferably, a counterbalance weight, such as the counterbalance weight 270 of FIG. 9 and a wind-resisting member such as the wind vane 268 of FIG. 9 are attached to the antenna-mounting ring 292 at a point circumferentially spaced from the housing 386. The counterbalance and wind vane assembly 262 of FIGS. 8 and 9 may be attached to the antenna-mounting ring 292 of FIGS. 14 and 15 in the same manner as is shown for attaching the counterbalance and wind vane assembly 262 to the antenna-mounting ring 142 of FIGS. 8 and 9, or by the use of an additional housing identical to the housing 386. The detailed construction of the counterbalance and wind vane does not form an inventive part of the present invention.

In summary, the embodiment of FIGS. 14 and 15 differs from the embodiment of FIGS. 8–13 in that the roller shafts 310 and 334 of FIGS. 14 and 15 are horizontally disposed whereas the roller shafts 182 and 218 of FIGS. 10 and 11 are vertically disposed. The embodiment of FIGS. 14 and 15 also varies from the embodiment of FIGS. 8–13 in that the clearance 346 between the support rollers 308 and the lower surface 304 of the V-shaped groove 302 is by means of the adjusting screw 336 whereas clearance between the rollers 166 and 219 and the lower surface 154 of the groove 150 of the embodiment of FIGS. 8–13 is by means of rotationally positioning the support roller assembly 168 or the support and drive assembly 202 about one of the tower legs, **20*a* or 20*c***.

Similarities between the embodiment of FIGS. 14 and 15 and the embodiment of FIGS. 8–13 include the mounting of three support rollers to respective ones of three antenna tower legs and both supporting and guiding an antenna-mounting ring by engagement of support and guide surfaces of support rollers with support and guide surfaces of a groove that is circumferentially disposed in the antenna-mounting ring.

Referring now to FIGS. 17–20, an antenna tower assembly 400 includes an antenna tower 12 having a plurality of vertically-disposed tower legs **20*a*–20*c*, a tower-attaching ring 402 being attached to the antenna tower 12 by brackets 404, an antenna-mounting ring 406 being circumferentially disposed about the tower-attaching ring 402, a support and drive assembly 408 being attached to the antenna-mounting ring 406 by bolts 410, an antenna 412, a support and counterbalance assembly 414 being attached to the antenna-mounting ring 406, a wind vane 416 being attached to the support and counterbalance assembly 414 and support roller assemblies 306 that are attached to the antenna-mounting ring 406** by means which will be subsequently described.

Figure 18:
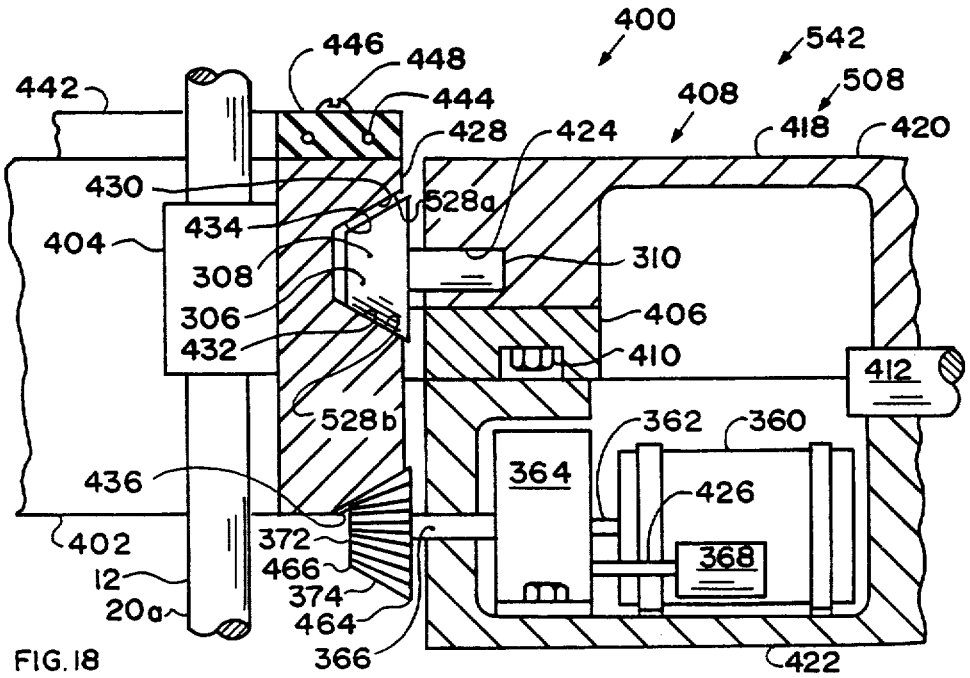
FIG. 18 is a cross-sectional view, taken substantially as shown by section line 18—18 of FIG. 19, showing the support and drive assembly for the embodiment of FIGS. 17–20 that utilizes two circumferentially-disposed rings.

Referring now to FIG. 18, the support and drive assembly 408 includes a housing 418 having an upper housing portion 420 and a lower housing portion 422, a support roller assembly 306 which was previously discussed in conjunction with FIG. 16, and whose shaft, 310, is horizontally disposed in a bore 424 in the upper housing portion 420, an electric drive motor 360 having an output shaft 362, a gear reducer unit 364 being driven by the output shaft 362 of the electric drive motor 360 and having an output shaft 366, a potentiometer 368 that is attached to the gear reducer unit 364 by a shaft 426, and a bevel gear or drive pinion 372 which includes circumferentially-spaced gear teeth 374 and which is attached to the output shaft 366.

The tower-attaching ring 402 includes a circumferential outer surface or circumferential ring surface 428 and a circumferentially disposed V-groove 430 in the circumferential outer surface 428. The groove 430 includes a lower circumferential surface or lower groove surface 432, and an upper circumferential surface or upper groove surface 434. The support roller 308 supportingly engages the support surface 434 of the tower-attaching ring 402.

The tower-attaching ring 402 also includes a plurality of circumferentially-spaced gear teeth 436. The gear teeth 374 of the drive pinion 372 selectively engage the gear teeth 436 as the electric drive motor 360 rotates the output shaft 366 through the gear reducer unit 364.

The antenna 412 is attached to the support and drive assembly 408 by clamping the antenna 412 between the housing portions 420 and 422 of the housing 418.

Figure 17:
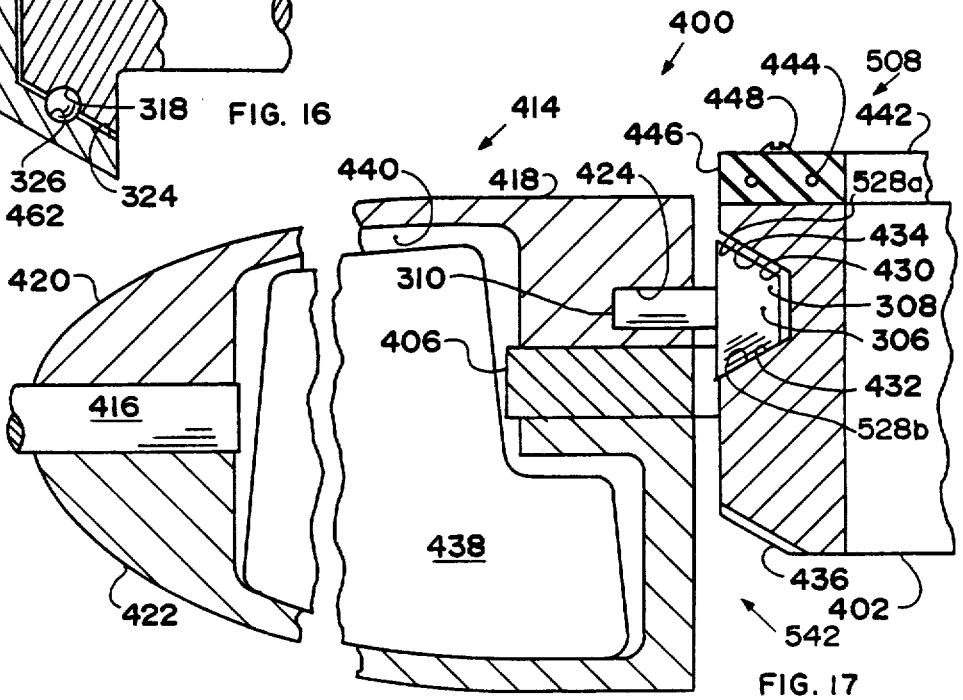
FIG. 17 is a cross-sectional view taken substantially as shown by section line 17—17 of FIG. 19, showing a support roller assembly for the embodiment of FIGS. 17–20 that utilizes two circumferentially-disposed rings.

Referring now to FIG. 17, the support and counterbalance assembly 414 includes a housing 418 having an upper housing portion 420 and a lower housing portion 422, a support roller assembly 306 which is retainingly inserted into a bore 424 of the top housing portion, and a counterbalance weight 438 which has been placed in a cavity 440 of the housing 418. The wind vane 416 is attached to the assembly 414 by clamping the wind vane 416 between the housing portions 420 and 422 of the housing 418.

An electrical resistance heating unit 442 includes an electrical resistance unit 444 that is molded in a dielectric body 446 and that is attached to the tower-attaching ring 402 by screws 448.

Figure 19:
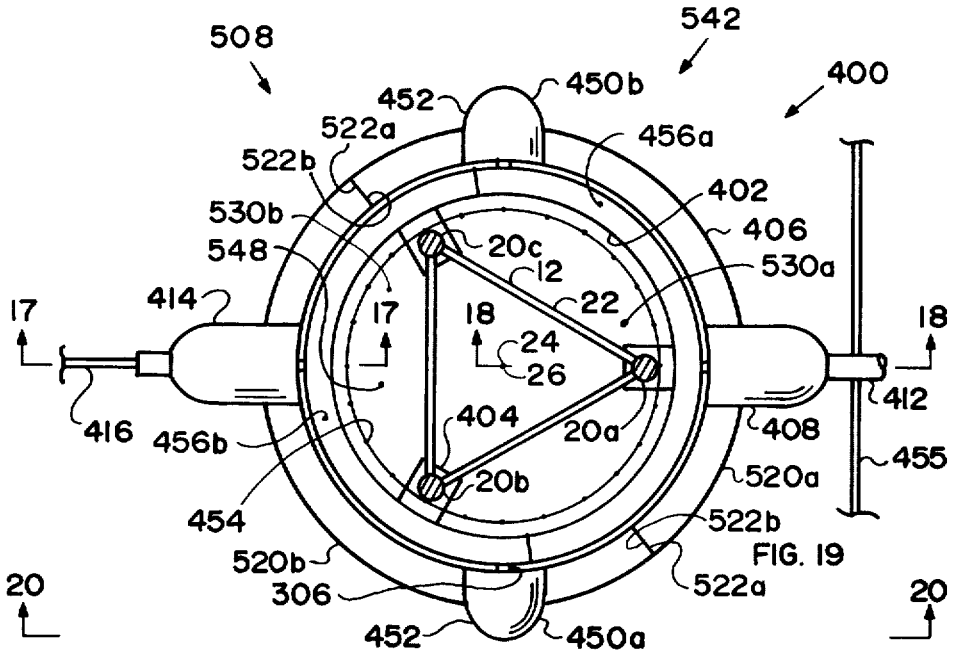
FIG. 19 is a top view of the embodiment that utilizes two circumferentially-disposed rings.
Figure 20:
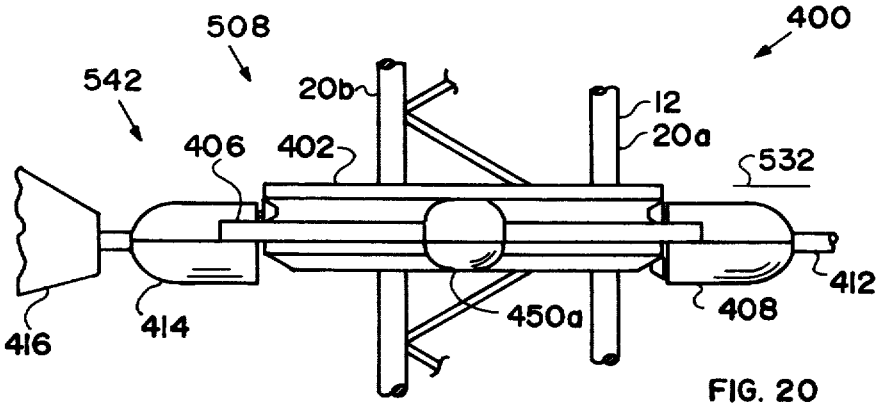
FIG. 20 is a side elevation of the embodiment that utilizes two circumferentially-disposed rings, taken substantially as shown by view line 20—20 of FIG. 19.

Referring now to FIGS. 19 and 20, the tower-attaching ring 402 is attached to the antenna tower 12 by the brackets 404; and the antenna-mounting ring 406 is attached to the tower-attaching ring 402 by four roller and bearing assemblies 306. One roller and bearing assembly 306 is a part of the support and drive assembly 408, a second one of the roller and bearing assemblies 306 is a part of the support and counterbalance assembly 414, and the other two of the roller and bearing assemblies 306 are a part of support roller assemblies 450*a* and 450*b*.

The support roller assemblies 450*a* and 450*b* are constructed the same as the support and counterbalance assembly 414 of FIG. 17 except that the counterbalance weight 438 is deleted, the wind vane 416 is deleted, and housings 452 of the assemblies 450*a* and 450*b* are shortened, as shown in FIG. 19, from the housing 418 of FIG. 17.

In summary, the embodiment of FIGS. 17–20 varies from the embodiment of FIGS. 14 and 15 in that the embodiment of FIGS. 17–20 includes two rings, 402 and 406, that are coaxially disposed, the tower-attaching ring 402 being attached to the antenna tower 12, and the antenna-mounting ring 406 being supportably and rotatably attached to the tower-attaching ring 402 by the roller and bearing assemblies 306. The embodiment of FIGS. 17–20 also differs from the embodiment of FIGS. 14 and 15 in that the electric drive motor 360 of FIGS. 17–20 rotates about the antenna tower 12; whereas the electric drive motor 360 of FIGS. 14 and 15 is stationary with respect to the antenna tower 12.

Figure 21:
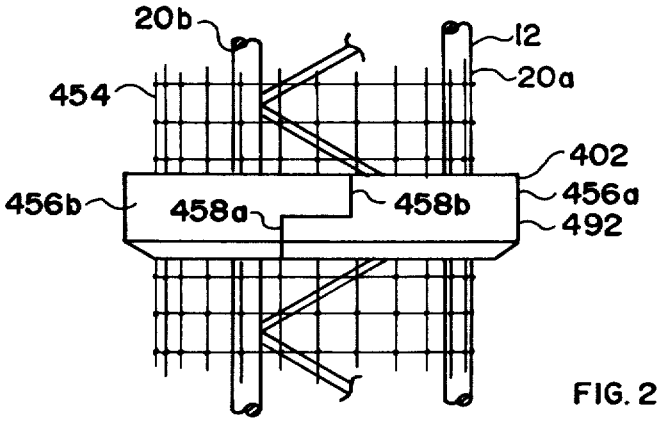
FIG. 21 is a partial side elevation, taken substantially the same as FIG. 20, but showing only the tower-attaching ring and the screen grid that is optional for use as a reflecting device between the tower-attaching ring and the antenna tower.

Referring now to FIGS. 19–21, and more particularly to FIG. 21, optionally, a cylindrically-shaped grid or reflecting device 454, is radially interposed between the antenna tower 12 and the tower-attaching ring 402, and is electrically bonded to the antenna tower 12. The purpose of the reflecting device 454 is to provide a reflecting surface that is uniform in size and is constant in distance from the antenna 412 to the antenna tower 12. As shown in FIG. 19, an element 455 of the antenna 412 remains at a constant distance from the reflecting device as the antenna 412 is rotated. Without the reflecting device 454, both the area of the reflecting surface, and the distance to the reflecting surface from the antenna 412 to the metal of the antenna tower 12 will vary slightly, depending upon the rotational position of the antenna tower 12 with respect to various ones of the tower legs, 20*a*–20*c*, and the strut bracing 22.

Referring again to FIG. 21, the tower-attaching ring 402 includes arcuate segments 456*a* and 456*b*. The arcuate segments 456*a* and 456*b* are identical and each includes a lapped-joint end 458*a* and 458*b*.

Referring now to FIG. 22, an antenna tower assembly 470 includes an antenna tower 12 having vertically-disposed tower legs 20*a*–20*c*, and a tower-attaching ring 402 that is attached to respective ones of the antenna tower legs 20*a*–20*c* by brackets 404. An antenna-mounting ring 472 is supportingly and rotatably attached to the tower-attaching ring 402 by antenna-attaching and support roller assemblies 474*a* and 474*b*, the support and drive assembly 408 of FIG. 18, two support and counterbalance assemblies 414 of FIG. 17, and a support roller assembly 450*a*. The support roller assembly 450*a* was described in conjunction with FIG. 19.

The antenna-attaching and support roller assemblies 474*a* and 474*b* each include one of the roller and bearing assemblies 306 and each is constructed substantially the same as the assembly 414 of FIG. 17. Thus it can be seen that the embodiment of FIG. 22 varies from the embodiment of FIGS. 17–20 only in that a Yagi antenna 476 is mounted to both of the assemblies 474*a* and 474*b* rather than being mounted to a single assembly, such as the assembly 408 of FIG. 18. Thus, a total of six assemblies, each having a roller and bearing assembly 306, are used to give greater support for large antennas, such as the Yagi antenna 476. Two support and counterbalance assemblies 414 are used to compensate for the extra size and weight of the Yagi antenna 476 over smaller antenna assemblies; and a wind vane 416 is attached to each of the assemblies 414 to compensate for the large size of the Yagi antenna 476.

Referring now to FIGS. 23–26, the method of assembly includes placing arcuate segments 456*a* and 456*b* around an antenna tower 12 that has vertically-disposed tower legs 20*a*–20*c*, connecting an end 482*a* of the segment 456*a* to an end 482*b* of the segment 456*b* to provide a tower-retaining or tower-retained ring 484 having unconnected lapped-joint ends 458*a* and 458*b*, moving the ring 484 up to guy wires 488, lifting the end 458*a* of the ring 484 above the end 458*b* of the ring 484 and above one of the guy wires 488 by rotating the segment 456*a* about a junction or connection 490 between the interconnected ends 482*a* and 482*b*, rotating the end 458*a* around the antenna tower 12, lifting the tower-retaining ring 484 to a desired height position as shown in FIG. 21, connecting the end 458*a* to the end 458*b* to make a complete ring 402 as shown in FIG. 21, and attaching the ring 402 to the antenna tower 12.

Referring again to FIGS. 23–26, the ends 458*a*, 458*b*, 482*a*, and 482*b*, are of the lapped end construction as shown and each includes two bolt holes 494. Two pieces of woven steel cable 496 and four cable clamps 498 are used to interconnect the ends 482*a* and 482*b* as shown in FIGS. 23 and 26, the cable clamps 498 being positioned on respective ones of the cables 496 to allow the end 458*a* to be lifted above the end 458*b*.

The use of the cables 496 through two of the holes 494 in the ends 482*a* and 482*b* is effective to prevent the ends 458*a* and 458*b* from being spaced-apart far enough for the ring 484 to be separated radially from the antenna tower 12. Therefore, the ring 484 is made to be tower-retaining by interconnecting the ends 482*a* and 482*b*.

In antenna tower assemblies of the type that utilize guy wires to achieve lateral stability of the antenna tower, it is sometimes necessary to disconnect one or more guy wires in order to raise the antenna and/or antenna-mounting parts upwardly past the guy wires.

In the present invention, a tower-attaching ring, an antenna-mounting ring, or any other ring or arcuate segment, may be built or assembled as a tower-retaining ring. Thus, whether the tower-retaining ring is a tower-attaching ring or an antenna-mounting ring, it is assembled to the tower 12, at any convenient height position, by moving a first arcuate segment transversely toward the tower 12 and into an arcuate relationship with the tower 12, by moving a second arcuate segment transversely toward the tower 12 and into tower-encircling relationship with the first arcuate segment, and by interconnecting ends of the arcuate segments.

The tower retaining ring, whether it be a tower-attaching ring or an antenna-mounting ring, may be raised above the guy wires by rotating one unconnected end above the guy wires. Thus the present invention obivates the danger of men working on a tower with one or more disconnected guy wires or the extra expense of temporarily attaching extra guy wires to provide lateral stability for the antenna tower while the permanent guy wires are disconnected.

The use of a tower-retaining ring also provides greater safety to the tower crew; because a tower-retaining ring, with any other equipment assembled thereto, may be pre-assembled at ground level and may be raised as a unit, being guidingly retained to the tower as the assembly is raised, as opposed to separately carrying many individual parts up the face of the tower and assembling them at the antenna-mounting height.

Referring now to FIGS. 8–13, the method of rotatably mounting an antenna 256 to an antenna tower 12 having three vertically-disposed tower legs, 20a–20c, comprises attaching one of the support housings 170 to each of two of the tower legs, 20a and 20b, attaching the support housing 204 to the tower leg 20c, placing the antenna-mounting ring 142 around the tower 12, rotatably connecting the ring 142 to the support housing 170 and to the support housing 204 by attaching the support rollers 160 and 219 to the housings 170 and 204, and attaching an antenna 256 to the ring 142.

Referring now to FIGS. 14–20, the method further includes electrically heating the antenna-mounting ring or second mounting portion 292 by the use of an electrical resistance heating unit 376, or electrically heating the tower-attaching ring or first mounting portion 402 by the use of an electrical resistance heating unit 442, and then rotationally positioning the antenna, 384 or 412, by use of the electric drive motor 360.

Referring now to FIGS. 1, 2, 8, 14–15, 17–20, and 22, if respective ones of the antennas 18, 256, 384, 412, and 476, and if respective ones of the antenna towers 12 are deleted from respective ones of the antenna tower assemblies 10, 40, 140, 290, 400, and 470, the respective antenna tower assemblies become rotationally positionable mounts 500, 502, 504, 506, 508, and 510, respectively.

Referring now to FIG. 8, the antenna-mounting ring 142 includes first and second arcuate segments 512a and 512b, each having first and second ends 514a and 514b. The arcuate segments 512a and 512b are positioned around the antenna tower 12 with the first ends 514a abutting the second ends 514b. The arcuate segments 512a and 512b may be interconnected by the attaching lug 258 and the bolts 260, and by the bolts 264 attaching the housing 266 to both of the arcuate segments 512a and 512b. However, the method and details of connection of the ends 514a and 514b of the segments 512a and 512b are not a part of the present invention.

Referring now to FIGS. 14 and 15, the antenna-mounting ring 292 includes first and second arcuate segments 516a and 516b, each having first and second ends 518a and 518b. The arcuate segments 516a and 516b are positioned around the tower 12 with the first ends 518a abutting the second ends 518b; and the arcuate segments 516a and 516b are interconnected by any suitable means. The detailed method of interconnecting the arcuate segments 518a and 518b is not a part of the present invention.

Referring now to FIG. 19, the antenna-mounting ring 406 includes first and second arcuate segments 520a and 520b, each having first and second ends 522a and 522b. The arcuate segments 520a and 520b are positioned around the tower 12 with the first ends 522a abutting the second ends 522b; and the arcuate segments 520a and 520b are interconnected by any suitable means.

Referring now to FIGS. 8, 11, 14, and 16–18, the arcuate segments 512a and 512b each include arcuate surfaces 524a and 524b, the arcuate segments 516a and 516b each include arcuate surfaces 526a and 526b, and the arcuate segments 456a and 456b each include arcuate surfaces 528a and 528b.

The upper circumferential surfaces 152, 302, and 434 each include one arcuate surface, 524a, 526a, or 528a, of both of the respective ones of the arcuate segments, 512a and 512b, 516a and 516b, or 456a and 456b; and the lower circumferential surfaces 154, 304, and 432 each include one arcuate surface, 524b, 526b, or 528b, of both of the respective ones of the arcuate segments 512a and 512b, 516a and 516b, or 456a and 456b.

The arcuate segments 14, 42, 512a, 512b, 516a, 516b, 520a, 520b, 456a, and 456b each include an opening, 530a or 530b, that is disposed radially inward of an arcuate surface, 15a or 15b, 82a or 82b, 152 or 154, 302 or 304, 432 or 434, and that opens outward between the ends 15a and 15b, 514a and 514b, 518a and 518b, 522a and 522b, 458a and 458b, of respective ones of the arcuate segments.

Preferably, all of the segments and rings are disposed about a vertical axis or segment axis 26 that is parallel to the neutral axis 24 of the antenna tower; so all of the segments and rings are disposed in a plane 532 that is orthogonal to the neutral axis 24; and so the circumferential surfaces 152, 154, 302, 304, 432, and 434 are disposed circumferentially around the axis 26. All of the rings 142, 292, 402, and 406 include a tower-receiving or tower-accepting opening 548 that includes the openings 530a and 530b of the respective arcuate segments.

Referring now to FIGS. 5 and 8, the antenna tower 12 includes three faces 534a–534c which comprise a side of the tower 12 that is disposed between any adjacent two of the tower legs 20a–20c. Thus, in broadest terms, the rotationally positionable mounts 500, 502, 504, 506, 508, and 510 are attached to a face 534a–534c of the tower 12, as opposed to being attached to a top (not shown) of the tower 12.

In the embodiment of FIGS. 8–13, the first mounting portion includes two of the support housings 170 and the support housing 204; and the antenna-mounting ring 292 is the second mounting portion.

In like manner, in the embodiment of FIGS. 14–16, the first mounting portion includes two of the support housings 342 and the support housing 328.

In contrast, in the embodiments of FIGS. 16–21 and FIG. 22, the antenna-attaching ring 402 is the first mounting poriton; and the second mounting portion includes the antenna-mounting ring 406 or the antenna-mounting ring 472.

In the embodiment of FIGS. 8–13, the first and second mounting portions are interconnected by attaching a support roller 166 to each of the support housings 170 and by attaching a support roller 219 to the support housing 204.

In the embodiments of FIGS. 14–16, FIGS. 16–21, and FIG. 22, the support rollers 306 are frustoconical in shape and include a large diameter end 460 that is adjacent to the roller shaft 310, and a small diameter end 462. In like manner, the drive pinion 372 includes a large diameter end 464 that is adjacent to the shaft 366, and a small diameter end 466.

Referring finally to FIGS. 2–5, 8–13, 14–16, and 16–22, if the antennas 18, 256, 384, 412, and 476 and the wind vanes 268 and 416 are deleted from the tower and rotationally positionable mount assemblies 40, 140, 290, 400, and 470, then the assemblies become tower and rotationally positionable mount assemblies 536, 538, 540, 542, and 544.

In summary, the present invention provides means for rotatably mounting one or more search devices to the face of a tower. The search devices which may be mounted include radio antennas, video cameras, and searchlights.

The present invention includes an embodiment wherein two vertically-spaced and arcuately-shaped rings are mounted to the three tower legs of the tower and the search device is supportingly guided on the arcuately-shaped rings.

The present invention includes two embodiments wherein a search-device mounting ring is rotatably attached to the three tower legs of the tower by a roller that is operatively attached to each tower leg and that engages a groove in the search-device mounting ring. In one of these embodiments, the roller shafts are vertically disposed and are both radially and circumferentially disposed about a vertical axis.

This vertical axis is preferably the neutral axis of the tower, but it may be any vertical axis that is disposed radially inside the tower legs and truss bracing of the tower.

In the other of these two embodiments, the roller shafts are disposed both orthogonally and radially with respect to a vertical axis.

The present invention includes a fourth embodiment wherein two rings are used. One ring is attached to the tower and the other ring is rotatably attached to the first ring by use of a plurality of rollers.

The present invention includes: roller and groove means for supporting, guiding, and stabilizing the search-device mounting ring, counterbalance means for counterbalancing the weight of a search device, torsional wind balance means for counteracting torsional wind loads that are applied to the tower by the search device, manual or electrical means for rotating the search device, means for locking the search device in a desired position, means for electrically heating and thus thawing ice from whichever ring includes gear teeth, a reflecting device that prevents an antenna from seeing a varying area of metal in the antenna tower as the antenna is rotated, apparatus and method for assembling the tower-attaching and antenna-mounting rings around the antenna tower at any convenient height, and a method for raising partially-assembled rings above guy wires.

The support rollers cooperate with a first circumferential surface to support a ring-shaped mounting portion, cooperate with a second circumferenial surface to vertically restrain the ring-shaped mounting portion and thereby to prevent tilting of the ring-shaped mounting portion, and cooperate with one of the mounting portions to radially guide the ring-shaped mounting portion, as shown in FIGS. 8, 11, 12, 14, 15, and 17–19.

The support rollers each include a roller shaft; and respective ones of the support rollers are supported, verticaly restrained, and radially restrained by operative attachment of the respective ones of the roller shafts to another mounting portion, as shown in the drawings.

The present invention provides apparatus and method for mounting a plurality of antennas, or search devices, to a single tower, and for separately rotating, or rotationally positioning, the antennas or search devices. Therefore, the present invention provides functional advantages over prior art systems wherein only one antenna can be rotated, and economic advantages over prior art systems wherein multiple towers are required.

Further, the present invention allows the use of larger antennas on a given size of tower, the use of a larger number of antenna on a given size of tower, or the use of a tower of smaller cross-sectional dimensions and less torsional rigidity for a given number of antennas of a given size; because all of the embodiments of the present invention apply torsional loads equally to all of the tower legs, and because of the torsional wind balance that is provided by the use of wind vanes, While particular apparatus has been shown and described, the scope of the present invention is to be determined by the appended claims. Further, the parenthetical numbers that have been inserted into the claims are for illustrative purposes only; and the parenthetical numbers are not a part of the claims. Therefore, the parenthetical numbers in the claims are not to be considered as a limitation to the scope of any claim.

INDUSTRIAL APPLICABILITY

The present invention provides apparatus and methods for the rotatable mounting and both separate and selective rotational positioning of a plurality of antennas or search devices on a single tower.

The present invention may be used by homeowners for mounting and rotating of antennas of the types used for receiving video signals, for broadcasting and receiving of citizens band radio signals, and for receiving both AM and FM radio signals.

The present invention may be used by radio amateurs for both broadcasting and receiving antennas, by commercial radio stations, by microwave transmission companies, and by the military forces for radio communications.

In addition, the present invention may be used to mount and separately rotate such search devices as directional receiving antennas, video cameras, and searchlights in such numbers or combinations as are needed.

What is claimed is:

1. A tower and rotationally positionable mount assembly (538, 540, 542, or 544) which comprises a tower (12) having a neutral axis (26);

a first mounting portion (170+204 of FIG. 8, 328+342 of FIGS. 14–15, or 406 or 418 of FIG. 18);

a first segment (512*a*, 516*a*, or 456*a*) having a first arcuate surface (524*a*, 524*b*, 526*a*, 526*b*, 528*a*, or 528*b*), and having a first opening (530*a*) that is disposed radially inward of said first arcuate surface and that opens radially outward from said first segment distal from said first arcuate surface;

a second segment (512*b*, 516*b*, or 456*b*) having a second arcuate surface (524*a*, 524*b*, 526*a*, 526*b*, 528*a*, or 528*b*), and having a second opening (530*b*) that is disposed radially inward of said second arcuate surface and that opens radially outward from said second segment distal from said second arcuate surface;

a second mounting portion (142 of FIG. 8, 292 of FIG. 14, or 402 of FIG. 18), being disposed circumferentially around said tower, and having a circumferential surface (152 or 154 of FIG. 12, 302 or 304 of FIGS. 14–15, or 432 or 434 of FIGS. 17–18) that includes both of said arcuate surfaces, that circumscribes said tower, and that is disposed around an axis (24) that is substantially parallel to said neutral axis;

securing means (174+206 of FIG. 8, 352+354 of FIG. 14, or 404 of FIG. 18) for operatively securing one (170+204 of FIG. 8, 328+342 of FIGS. 14–15, or 402 of FIGS. 17–18) of said mounting portions to said tower;

attaching means, comprising said circumferential surface, for supportingly attaching the other (142, 292, 406, or 418) of said mounting portions to said one mounting portion, for permitting said other mounting portion to be rotationally positioned with respect to said one mounting portion, for radially guiding said other mounting portion by operative contact of said circumferential surface with said first mounting portion, and for vertically restraining said other mounting portion; and means (214+222+158 of FIGS. 8 and 11, 214+186+152 or 154 of FIGS. 8, 11, and 13, or 360+372+370 of FIGS. 14 or 18) for rotationally positioning said other mounting portion with respect to said one mounting portion.

2. A tower and rotationally positionable mount assembly (540 or 542) as claimed in claim 1 in which said assembly includes means (376 or 442) for electrically heating said second mounting portion (292 or 402).

3. A tower and rotationally positionable mount assembly (542) as claimed in claim 1 in which said tower (12) includes three vertically-disposed tower legs (20*a*–20*c*);

said assembly includes an antenna (412) that is operatively attached to said other (406) mounting portion; and said assembly includes a reflecting device (454) that circumscribes said three tower legs, that is disposed radially intermediate of said tower and said antenna, that is operatively attached to one (402 of FIG. 19) of said mounting portions, and that is electrically connected to said antenna tower.

4. A tower and rotationally positionable mount assembly (538, 540, 542, or 544) which comprises a tower (12) including three tower legs (20*a*–20*c*), and having a neutral axis (26);

a first mounting portion (170+204 of FIG. 8, 328+342 of FIGS. 14–15, or 406 or 418 of FIG. 18);

a first segment (512*a*, 516*a*, or 456*a*) having a first arcuate surface (524*a*, 524*b*, 526*a*, 526*b*, 528*a*, or 528*b*), and having a first opening (530*a*) that is disposed radially inward of said first arcuate surface and that opens radially outward from said first segment distal from said first arcuate surface;

a second segment (512*b*, 516*b*, or 456*b*) having a second arcuate surface (524*a*, 524*b*, 526*a*, 526*b*, 528*a*, or 528*b*), and having a second opening (530*b*) that is disposed radially inward of said second arcuate surface and that opens radially outward from said second segment distal from said second arcuate surface;

a second mounting portion (142 of FIG. 8, 292 of FIG. 14, or 402 of FIG. 18), being disposed circumferentially around said three tower legs, and having a circumferential surface (152 or 154 of FIG. 12, 302 or 304 of FIGS. 14–15, or 432 or 434 of FIGS. 17–18) that includes both of said arcuate surfaces, that circumscribes said three tower legs, and that is disposed around an axis (24) that is substantially parallel to said neutral axis;

securing means (174+206 of FIG. 8, 352+354 of FIG. 14, or 404 of FIG. 18) for operatively securing one (170+204 of FIG. 8, 328+342 of FIGS. 14–15, or 402 of FIGS. 17–18) of said mounting portions to said tower;

attaching means, comprising a plurality of roller shafts (182, 188, 218, 310, or 334) that are operatively attached to said first mounting portion, comprising a plurality of rollers (160, 186, 219, or 306) that are attached to respective ones of said roller shafts, and comprising said circumferential surface, for supportingly attaching said other (142, 292, 406, or 418) mounting portion to said one (170+204, 328+342, or 402) mounting portion, for permitting said other mounting portion to be rotationally positioned with respect to said one mounting portion, for radially guiding said other mounting portion, and for vertically restraining said other mounting portion; and means (214+220+158 of FIGS. 8 and 11, 214+186+152 or 154 of FIGS. 8, 11, and 13, or 360+372+370 of FIGS. 14 or 18) for rotationally positioning said other mounting portion with respect to said one mounting portion.

5. A tower and rotationally positionable mount assembly (540 or 542) as claimed in claim 4 in which one of said roller shafts (310 or 334) is disposed orthogonally and radially with respect to said parallel axis (24).

6. A tower and rotationally positionable mount assembly (538, 540, 542, 544) as claimed in claim 4 in which said second mounting portion (142, 292, or 402) includes a circumferential groove (150, 298, or 430) that includes an upper (152, 302, or 434) groove surface and a lower (154, 304, or 432) groove surface; and said supportingly attaching of said other (142, 292, 406, or 418) mounting portion comprises one of said rollers (160, 186, 219, or 306) operatively engaging one of said groove surfaces.

7. A tower and rotationally positionable mount assembly (538, 540, or 542) as claimed in claim 4 in which said means for rotationally positioning said other mounting portion (142, 292, 418, or 406) comprises an electric drive motor (214 or 360) being operatively attached to said first mounting portion (204, 328, or 418), a plurality of gear teeth (158 or 370) being circumferentially disposed on said second mounting portion, and a toothed drive pinion (220 or 372) being operatively attached (218, or 364+366) to said electric drive motor and progressively meshing with said gear teeth.

8. A tower and rotationally positionable mount assembly (538, 540, 542, or 544) as claimed in claim 4 in which said means for rotationally positioning comprises a drive motor (214 or 360) being operatively attached to said first (204, 328, or 418) mounting portion and operatively engaging (220+158 of FIGS. 8 and 11, 186+152 or 154 of FIGS. 11 and 13, or 370+372 of FIG. 14 or 18) said second (142, 292, or 402) mounting portion.

9. A tower and rotationally positionable mount assembly (538, 540, 542, or 544) as claimed in claim 4 in which said assembly includes a second (152 or 154, 302 or 304, or 432 or 434) circumferential surface; and said means for vertically restraining comprises one of said circumferential surfaces.

10. A tower and rotationally positionable mount assembly (542 or 544) as claimed in claim 4 in which said first mounting portion (418) includes a ring-shaped mounting portion (406) that is disposed circumferentially around said tower; and said ring-shaped mounting portion includes a third segment (520*a*), a fourth segment (520*b*), and means for connecting said third segment to said fourth segment.

11. A tower and rotationally positionable mount assembly (542 or 544) as claimed in claim 10 in which said securing of said one mounting portion to said tower (12) comprises securing said second (402) mounting portion to said tower.

12. A tower and rotationally positionable mount assembly (542 or 544) as claimed in claim 4 in which said other mounting portion comprises said first (418) mounting portion.

13. A tower and rotationally positionable mount assembly (542 or 544) as claimed in claim 12 in which said assembly includes a second (432 or 433) circumferential surface; and said means for vertically restraining comprises one of said circumferential surfaces.

14. A tower and rotationally positionable mount assembly (542 or 544) as claimed in claim 12 in which said second mounting portion (402) includes a circumferential groove (430) that includes an upper (434) and a lower (432) groove surface; and said circumferential surface comprises one of said groove surfaces.

15. A tower and rotationally positionable mount assembly (540 or 542) as claimed in claim 12 in which said means for rotationally positioning comprises a drive motor (360) being operatively attached to said other (418) mounting portion and operatively engaging (370+372) said one (402) mounting portion.

16. A rotationally positionable mount (504 of FIGS. 8–13, 506 of FIGS. 14–16, 508 of FIGS. 16–21, or 510 of FIG. 22) for attachment to a tower (12), for attachment of a device (256 or 266 of FIG. 8, 384 of FIG. 14, 416 of FIG. 17, 412 of FIG. 18, or 476 of FIG. 22) to said mount, and for rotation of said device around said tower, which rotatable mount comprises;

a first segment (512*a*, 516*a*, or 456*a*) having a first arcuately-shaped surface (524*a*, 524*b*, 526*a*, 526*b*, 528*a*, or 528*b*), having a first opening (530*a*) that is disposed radially inward of said first arcuate surface and that opens radially outward from said first segment distal from said first arcuate surface;

a second segment (512*b*, 516*b*, or 456*b*) having a second arcuately-shaped surface (524*a*, 524*b*, 526*a*, 526*b*, 528*a*, or 528*b*), having a second opening (530*b*)that is disposed radially inward of said first arcuate surface and that opens radially outward from said first segment distal from said first arcuate surface;

first mounting portion means (142 of FIG. 8, 292 of FIGS. 15–16, or 402 of FIGS. 17–18), comprising said first and said second segments, comprisng means for connecting said first segment to said second segment, and comprising a circumferential surface (152, 154, 302, 204, 432, or 434) that includes both of said arcuately-shaped surfaces, for providing a tower-receiving opening (548) that comprises said first and said second openings, and for tower-encircling assembly around said tower by moving said first and second segments transversely toward said tower;

second mounting portion means, including first, second, and third attaching portions (170+204, or 418), and comprising means (12 or 230 of FIG. 8, 12 of FIGS. 14–15, 406 of FIGS. 17–21, or 406 of FIG. 22) for determinately spacing said attaching portions;

attaching means, comprising said attaching portions, and comprising said circumferential surface, for supportingly attaching one (142 of FIG. 8, 292 of FIGS. 14–15, or 418 of FIGS. 17–18) of said mounting portion means to the other (170+204 of FIG. 8, 328+342 of FIGS. 14–15, or 402 of FIGS. 17–18) of said mounting portion means, for permitting said one mounting portion means to be rotationally positioned with respect to said other mounting portion means, for radially guiding said one mounting portion means by operative contact of said second mounting portion means with said first mounting portion means, and for vertically restraining said one mounting portion means; and means (214+220+158 of FIGS. 8 and 11, 214+186+152 or 154 of FIGS. 8, 11, and 13, or 360+372+370 of FIG. 14 or 18) for rotationally positioning said one mounting portion means with respect to said other mounting portion means.

17. A rotationally positionable mount (504, 506, 508, or 510) as claimed in claim 16 in which said attaching means, and said radial guiding thereof, comprises a roller (160, 186, 219, or 306) that is radially restrained by said other attaching portions; and said attaching means, and said radial guiding thereof further comprises said roller radially guiding said one mounting portion.

18. A rotationally positionable mount (504, 506, 508, or 510) as claimed in claim 16 in which said attaching means includes a plurality of roller shafts (182, 188, 218, 310, or 334) that are operatively attached to respective ones of said first, second, and third attaching portions;

said attaching means further comprises a plurality of rollers (160, 186, 219, or 306) that are operatively attached to respective ones of said roller shafts; and said supportingly attaching of said one (142, 292, or 418) mounting portion means to said other mounting portion means (170+204, 328+342, or 402) comprises one of said rollers supportingly engaging said first mounting portion means.

19. A rotationally positionable mount (504, 506, 508, or 510) as claimed in claim 18 in which one of said mounting portion means (142, 292, or 402) includes a second circumferential surface (152, 154, 302, 304, 432, or 434); and said vertical restraining comprises one of said circumferential surfaces.

20. A rotationally positionable mount (504, 506, 508, or 510) as claimed in claim 18 in which said first mounting portion (142, 292, or 402) includes a circumferential groove (150, 298, or 430) that includes upper (152, 302, or 434) and lower (154, 304, or 432) groove surfaces; and one of said circumferential surfaces comprises one of said groove surfaces.

21. A rotationally positionable mount (504, 506, 508, or 510) as claimed in claim 20 in which said groove (150, 298, or 430) extends radially inward from a ring surface (148, 300, or 428) of said first mounting portion (142, 292, or 402);

said upper (152, 302, or 434) and lower (154, 304, or 432) groove surfaces diverge as said groove surfaces approach said ring surface;

one of said rollers (160, 188, 219, or 306) is profiled (162 of FIG. 10 or 316 of FIG. 16) to conform with said diverging of said groove surfaces; and said radial guiding comprises operative engagement of said roller profile with said diverging grooves.

22. A rotationally positionable mount (504, 506, 508, or 510) as claimed in claim 18 in which said first mounting portion includes a second circumferential surface (152, 154, 302, 304, 432, or 434); and said attaching means, and said radial guiding thereof, comprises one of said rollers (160, 186, 219, or 306) operatively engaging one of said circumferential surfaces.

23. A rotationally positionable mount (508 or 510) as claimed in claim 18 in which said means for determinately spacing said attaching portions (170+204, 328+342, or 418) comprises a ring-shaped mounting portion (406) that includes third (520*a*) and forth (520*b*) segments, and that includes means for connecting said third segment to said fourth segment.

24. A rotationaly positionable mount (508 or 510) as claimed in claim 18 in which said means for rotationally positioning comprises a drive motor (360) being operatively attached to said second mounting portion (418) and operatively engaging (370+372 of FIG. 18) said first mounting portion (402).

25. A method for mounting a device to a tower (12), which method comprises the following steps:

(a) placing first (456*a*) and second (456*b*) arcuate ring segments around said tower at a first height position thereof;

(b) connecting said first and second arcuate ring segments into a tower-retained ring (484) having first (458*a*) and second (458*b*) unconnected ends, after said placing step;

(c) moving said tower-retained ring upwardly to a guy wire (488);

(d) lifting one (458*a*) of said unconnected ends of said tower-retained ring above said guy wire;

(e) rotating said tower-retained ring with said one end of said tower-retained ring passing above said guy wire;

(f) moving said tower-retained ring to a desired height position;

(g) operatively securing said tower-retained ring to said tower at said desired height position; and (h) operatively securing a device to said tower-retained ring.

26. A method as claimed in claim 25 in which said lifting step comprises rotating said one end (458*a*) upwardly with respect to the other (458*b*) of said ends around said connection (490) of said first (456*a*) and second (456*b*) arcuate ring segments.

27. A method for mounting a device (256, 266, 384, 412, or 416) to a vertically-disposed tower (12) having a neutral axis (26), and for rotationally positioning said device, which method comprises:

(a) moving a first arcuate segment (512*a*, 516*a*, or 456*a*) orthogonally toward said tower and into an arcuate relationship to said tower;

(b) moving a second arcuate segment (512*b*, 516*b*, or 456*b*) orthogonally toward said tower, into an arcuate relationship to said tower, and into a tower-encircling relationship with said first arcuate segment;

(c) interconnecting said arcuate segments into a ring-shaped first mounting portion (142, 292, or 402) that encircles said tower;

(d) providing a second mounting portion (170+204, 328+342, 406, or 418);

(e) operatively attaching one (170+204, 328+342, or 402) of said mounting portions to said tower; and (f) rotatably attaching the other (142, 292, 406, or 418) of said mounting portions to said one mounting portion.

28. A method as claimed in claim 27 in which said rotatable attaching step comprises:

(a) supportively securing a plurality of circumferentially-spaced roller shafts (182, 188, 218, 310, or 334) to said second mounting portion (170+202, 328+342, or 406);

(b) operatively attaching a roller (160, 186, 219, or 306) to respective ones of said roller shafts; and (c) supportingly engaging said first mounting portion (142, 292, or 402) with one of said support rollers.

29. A method as claimed in claim 27 in which said method further comprises:

(a) operatively attaching a drive motor (214 or 360) to said second (204, 328, or 418) mounting portion; and (b) operatively engaging said drive motor with said first (142, 292, or 402) mounting portion.

30. A method as claimed in claim 27 in which said attaching of said second mounting portion (418) to said tower comprises:

(a) moving a third arcuate segment (520*a*) orthogonally toward said tower and into an arcuate relationship with said tower;

(b) moving a fourth arcuate segment (520*b*) into a tower-encircling relationship with said third arcuate segment; and (c) interconnecting said third and fourth arcuate segments into a ring-shaped second mounting portion (406).

* * * * *